US006908042B2

(12) United States Patent
Kuzuyama

(10) Patent No.: US 6,908,042 B2
(45) Date of Patent: Jun. 21, 2005

(54) FUEL INJECTOR

(75) Inventor: Hiroshi Kuzuyama, Aichi-ken (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 40 days.

(21) Appl. No.: 09/910,398

(22) Filed: Jul. 20, 2001

(65) Prior Publication Data

US 2002/0008157 A1 Jan. 24, 2002

(30) Foreign Application Priority Data

Jul. 21, 2000 (JP) ..... 2000-220227

(51) Int. Cl.[7] ..... F02M 47/02; F02M 59/00; B05B 1/30

(52) U.S. Cl. ..... 239/88; 239/533.2; 239/533.3; 239/585.1; 239/585.3; 239/585.4; 239/585.5

(58) Field of Search ..... 239/88, 89, 91, 239/92, 93, 533.1, 533.2, 533.9, 124, 126, 127, 585.1, 585.3, 585.4, 585.5; 251/129.15, 129.21, 127

(56) References Cited

U.S. PATENT DOCUMENTS

| | | | | | |
|---|---|---|---|---|---|
| 4,527,737 | A | * | 7/1985 | Deckard | 239/89 |
| 4,550,875 | A | * | 11/1985 | Teerman et al. | 239/88 |
| 4,628,881 | A | * | 12/1986 | Beck et al. | 123/447 |
| 4,850,828 | A | * | 7/1989 | Yonezawa | 417/252 |
| 5,819,704 | A | * | 10/1998 | Tarr et al. | 123/467 |
| 6,085,727 | A | * | 7/2000 | Nakano | 123/447 |

FOREIGN PATENT DOCUMENTS

| | | | |
|---|---|---|---|
| JP | 10-252611 | 9/1998 | F02M/61/16 |
| JP | 11-343946 | 12/1999 | F02M/61/16 |

* cited by examiner

*Primary Examiner*—Davis Hwu
(74) *Attorney, Agent, or Firm*—Morgan & Finnegan, LLP

(57) ABSTRACT

A fuel injector includes a pressure intensifying chamber communicating with a fuel supply passage through a check valve, a plunger for pressure-intensifying fuel introduced into the pressure intensifying chamber, and a needle valve for injecting the fuel pressure-intensified in the pressure intensifying chamber through an injection port, wherein there is provided in the fuel supply passage a throttle passage normally communicating with a fuel drain passage, air being bled during startup while leaking fuel.

3 Claims, 4 Drawing Sheets

FUEL INJECTOR

BACKGROUND OF THE INVENTION

The present invention relates to a pressure intensifying fuel injector for use in a vehicle diesel engine or the like and, in particular, to a fuel injector which allows air bleeding, for example, during startup.

DESCRIPTION OF THE RELATED ART

There are two types of fuel injectors for use in vehicle diesel engines or the like: accumulation-type fuel injectors injecting fuel accumulated at a predetermined pressure, and pressure-intensifying-type fuel injectors pressurizing fuel when injecting it.

In either type of fuel injectors, the fuel system is subject to air intrusion when, for example, the fuel injector is mounted in the engine, when maintenance is performed thereon, or when the piping is replaced. Thus, it is necessary to perform air bleeding when cranking the engine.

There has been proposed an accumulation-type fuel injector in which fuel at a predetermined pressure is supplied to the fuel injector with a predetermined timing, wherein an electromagnetic valve for opening and closing the injection port of the fuel injector is operated with a timing different from the above-mentioned predetermined timing to thereby automatically effect air bleeding (See Japanese Patent Application Laid-Open No. 10-252611).

In the case of a pressure-intensifying-type fuel injector, however, the system for supplying fuel to the pressure intensifying chamber and the operating fluid system for operating the plunger of the pressure intensifying chamber are two separate systems, and the electromagnetic valve does not directly opens and closes the needle valve for injecting fuel. Thus, it is impossible to exclusively bleed air by operating the electromagnetic valve.

It might be possible to provide an opening/closing valve in the fuel supply passage of a fuel injector and bleed air through this opening/closing valve. In this case, however, it would be necessary to open or close this valve through manual operation or the like at the time of cranking, which means it would be impossible to automatically effect bleeding. Further, the provision of the opening/closing valve would complicate the structure.

SUMMARY OF THE INVENTION

The present invention has been made in view of the above problems in the prior art. It is accordingly an object of the present invention to provide a pressure-intensifying-type fuel injector which allows air bleeding to be conducted automatically and with a simple structure.

To achieve the above object, there is provided, in accordance with the present invention, a fuel injector comprising a pressure intensifying chamber communicating with a fuel supply passage through a check valve, a plunger for pressure-intensifying fuel introduced into the pressure intensifying chamber, and a needle valve for injecting the fuel pressure-intensified in the pressure intensifying chamber through an injection port, wherein there is provided in the fuel supply passage a throttle passage normally communicating with a fuel drain passage.

In this construction, when fuel is supplied to the fuel supply passage at the time of cranking, the pressure in the fuel supply passage increases, and a fuel flow from the throttle passage to the fuel drain passage is formed. With this fuel flow, the air existing in the fuel supply passage is forced into the drain passage. Since the fuel is pressure-intensified in the pressure intensifying chamber, the fuel supplied to the fuel supply passage is at a low pressure of approximately several atmospheres. Thus, it is possible to perform air bleeding while keeping the amount of fuel leaked from the throttle passage small. After the air bleeding, the fuel from the fuel supply passage continues to flow to the drain passage by way of the throttle passage. This fuel circulates by way of the fuel tank, etc. to be supplied to the fuel supply passage again. Thus, the amount of fuel leaked to the drain passage through the throttle passage is not so large, and the throttle passage provides an aperture large enough to allow air bleeding.

DESCRIPTION OF THE PREFERRED EMBODIMENTS

Figure 1:
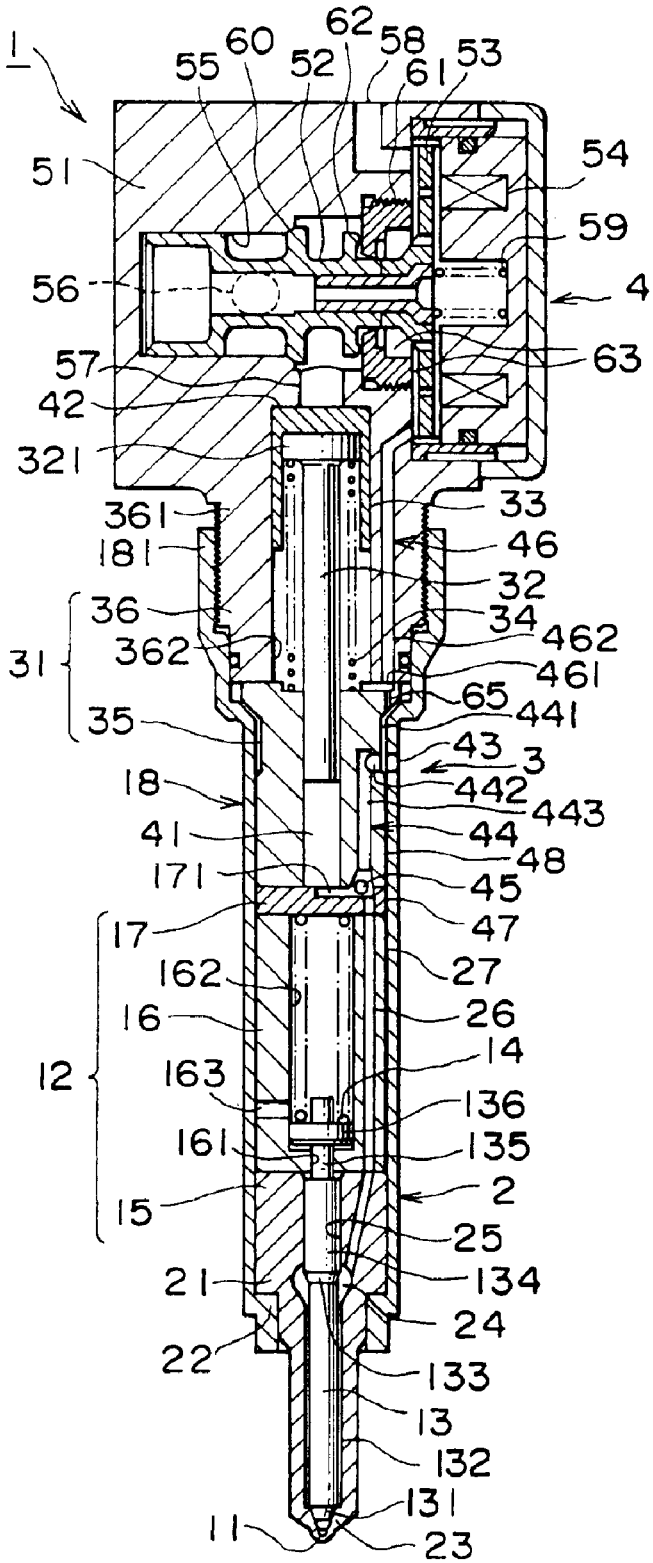
FIG. 1 is a sectional view showing a fuel injector according to an embodiment of the present invention in a state prior to injection start.

First, the construction of a fuel injector 1 will be described. In FIG. 1, successively arranged from below in the fuel injector 1 are an injection mechanism 2, a pressure intensifying mechanism 3, and an electromagnetic valve 4. This fuel injector 1 is mounted in an engine, such as a diesel engine, in an attitude in which the injection mechanism 2 is directed downwards as shown in the drawing. This downwardly directed position is not restricted to the vertical one. The injection mechanism 2 may also be directed obliquely downwards.

The injection mechanism 2 has a nozzle body 12 at the lower end of which an injection port 11 is open. In the nozzle body 12, an axially slidable needle 13 is biased by a presser spring 14. The nozzle body 12 comprises a first body 15, a second body 16, and a third body 17, which are successively arranged from below in that order. These bodies are put into a cylindrical casing 18 one by one.

The first body 15 is a cylindrical member whose forward end portion is relatively narrow and which has a shoulder portion 21. The shoulder portion 21 abuts a step portion 22 of the casing 18, and the forward end portion of the first body 15 having the injection port 11 protrudes downwardly. Provided in the first body 15 are a conical valve seat 23, a storage portion 24 for high-pressure fuel, and a slide hole 25 for the needle 13. A needle valve is formed by the valve seat 23 of the first body 15 and the needle 13.

The needle 13 comprises a conical valve portion 131 facing the valve seat 23, a small diameter portion 132, a step portion 133, a large diameter portion 134, a neck portion 135, and a spring seat 136, which are arranged in that order from below. The second body 16 includes a retaining hole 161 for the neck portion 135 of the needle 13, and an accommodating chamber 162 for the presser spring 14. The presser spring 14 in the accommodating chamber 162 is loaded into the casing 18, with the third body 17 thereon so as to downwardly bias the needle 13.

A supply passage 26 for high-pressure fuel extends through the third body 17 and the second body 16 so as to be offset from the centers of these bodies. This supply passage 26 extends through the first body 15 to communicate with the storage portion 24 for high-pressure fuel.

The injection mechanism 2, constructed as described above, operates as follows. When high-pressure fuel is supplied to the storage portion 24 by way of the supply passage 26, the step portion 133 of the needle 13, etc. receive pressure, with the result that a pressurizing force counteracting the biasing force of the presser spring 14 acts on the needle 13. When the pressure of the high-pressure fuel reaches a predetermined level, the pressurizing force of the high-pressure fuel and the biasing force of the presser spring 14 are in equilibrium with each other. The needle 13 then moves upwards, and the valve portion 131 at the forward end thereof is separated from the valve seat 23, with the result that high-pressure fuel at a predetermined pressure is injected through the injection port 11. As long as high-pressure fuel continues to be supplied to the storage portion 24, the injection of high-pressure fuel at a predetermined pressure through the injection port 11 continues. When high-pressure fuel ceases to be supplied to the storage portion 24, and the pressure in the storage portion 24 decreases, the presser spring 14 acting on the needle 13 causes the valve portion 131 at the forward end of the needle to be seated on the valve seat 23, and the injection of fuel through the injection port 11 is stopped.

The fuel leaking through the slide portion between the slide hole 25 of the first body 15 and the large diameter portion 134 of the needle 13 passes through the gap between the retaining hole 161 and the neck portion 135, reaches the accommodating chamber 162, reaches an annular passage 27 between the casing 18 and the second body 16 by way of a passage 163, and communicates with a fuel supply passage 44 at low pressure positioned above.

The pressure intensifying mechanism 3 positioned above the injection mechanism 2 includes a cylinder body 31, which contains an axially slidable plunger 32 joined to a pressure intensifying piston 33, with a return spring 34 acting on the plunger 32. The cylinder body 31 comprises a fourth body 35 and a fifth body 36, which are successively loaded into the casing 18. A threaded portion 361 of the fifth body 36 and a threaded portion 181 of the casing 18 are threadedly engaged with each other.

Formed in the fourth body 35 is a pressure intensifying chamber 41 in the form of a small diameter hole, into which the plunger 32 is slidably fitted. Formed in the fifth body 36 is a pressurizing chamber 42 in the form of a large diameter hole, into which the pressure intensifying piston 33 is slidably fitted. The plunger 32 has at its upper end a head portion 321, which is engaged with the pressure intensifying piston 33. Further, the return spring 34 is arranged between the head portion 321 of the plunger 32 and the upper end of the fourth body 35.

In the side surface the portion of the casing 18 corresponding to the fourth body 35, there is formed a fuel supply port 43. Over the fourth body 35 and the third body 17, there is formed a fuel supply passage 44 extending from the supply port 43 to the pressure intensifying chamber 41. This fuel supply passage 44 is formed by an annular space 441 defined by a recess in the outer periphery of the fourth body 35, a lateral passage 442 in the fourth body 35, a longitudinal passage 443 in the fourth body 35, and a radial passage 171 in the top surface of the third body 17. There is arranged a check valve 45 which vertically operates at the portion where the longitudinal passage 443 communicates with the radial passage 171. The forward direction for the check valve 45 is the direction toward the pressure intensifying chamber 41. Further, the radial passage 171 of the third body 17 also communicates with the supply passage 26 for high-pressure fuel.

Drain from the pressure intensifying chamber 41 for the plunger 32 flows into the accommodating chamber 362 accommodating the return spring 34, the accommodating chamber 362 forming the pressurizing chamber 42 of the fifth body 36. This accommodating chamber 362 communicates with a first drain passage 46, which is formed by a lateral groove 461 of the fourth body 35 and a longitudinal passage 462 of the fifth body 36, and communicates with a discharge port 58 by way of a second drain passage 63 described below.

The operation of the pressure intensifying mechanism 3, constructed as described above, is as follows. As will be described in detail below, when an operating fluid is supplied to the pressurizing chamber 42, the fuel in the pressure intensifying chamber 41 is pressurized by the pressure intensifying ratio which is determined by the ratio of the outer diameter of the pressure intensifying piston 33 to the outer diameter of the plunger 32. Since the check valve 45 is closed, the high-pressure fuel pressurized in the pressure intensifying chamber 41 flows to the supply passage 26. When the operating fluid is discharged from the pressurizing chamber 42, the pressure intensifying piston 33 and the plunger 32 are raised by the biasing force of the return spring 34, and the check valve 45 is opened, with the result that fuel is introduced into the pressure intensifying chamber 41 by way of the fuel supply passage 44 and the supply port 43.

The fuel leaked in the injection mechanism 2 flows from the annular passage 27 between the second body 16 and the casing 18 to the fuel supply passage 44 by way of an annular passage 47 between the third body 17 and the casing 18 and an annular passage 48 between the fourth body 35 and the casing 18. The outer diameter of the third body 17 in the form of a short cylinder is larger than the outer diameter of the second body 16 and the outer diameter of the portion of the fourth body 35 extending up to the annular space 441, and the annular passage 47 has a minimum gap for allowing passage of the leaked fuel. Due to this third body 17, the second body 16 is maintained in a position in which it extends along the axis.

The construction and operation of the electromagnetic valve 4 for supplying and discharging operating fluid to and from the pressurizing chamber 42 will be described. The fifth body 35 has at its top a block 51. The electromagnetic valve 4 comprises a valve plug 52, a yoke 53, and a solenoid 54, which are accommodated in the block 51, and is formed as a three-way two-position switching valve. The block 51 has a valve hole 55 extending perpendicular to the axial direction. Open in the valve hole 55 are an operating fluid supply port 56, an input/output port 57 communicating with the pressurizing chamber 42, and a discharge port 58 communicating with a fuel tank or a recovery device. The valve plug 52 is slidably fitted into the valve hole 55. A presser spring 59 acts on the yoke 53 connected to the valve plug 52, whereby a first valve 60 between the valve plug 52 and the block 51 is closed, and a second valve 62 between the valve plug 52 and a valve hole partition 61 is open. In this state, the input/output port 57 communicates with the discharge port 58 by way of a second drain passage 63 formed by the inner periphery of the valve hole partition 61 and the passage of the side surface of the yoke 53. When the yoke 53 connected to the valve plug 52 is attracted by the solenoid 54, the second valve 62 is closed, and the first valve 60 is opened. In this state, the supply port 56 communicates with the input/output port 57, and the operating fluid is introduced into the pressurizing chamber 42.

The first drain passage 46 of the pressure intensifying mechanism 3 communicates with the discharge port 58 through the second drain passage 63 of the electromagnetic valve 4. As will be described below, a fuel is used as the operating fluid for the pressurizing chamber 42 of the pressure intensifying mechanism 3, so that the first drain passage 46 and the second drain passage 63 communicate with each other, and the leak is returned to a common fuel tank or recovery device.

The fuel supply passage 44 of the pressure intensifying mechanism 3 communicates with the first drain passage 46 through a throttle hole 65. This throttle hole 65 consists of a linear hole formed directly above the annular space 441 of the fuel supply passage 44, and is open on a lateral groove 461 of the first drain passage 46. This throttle hole 65 may also be a lateral hole which is open on the lateral groove 461 from the upper end of the annular space 441. Further, it may also be a hole in the fifth body 36 extending from the upper end of the annular space 441 obliquely to the longitudinal passage 462.

This throttle hole 65 constantly leaks low-pressure fuel from the supply port 43. When the fuel contains some air, it is possible to allow the air to pass with the leakage of the fuel. Thus, the throttle hole 65 is adjusted such that air is allowed to pass with the leakage of fuel and that the amount of leak fuel passing the first drain passage 46 and the second drain passage 63 is somewhat increased. This throttle hole 65 forms a throttle passage normally communicating with the fuel drain passage.

Figure 2:
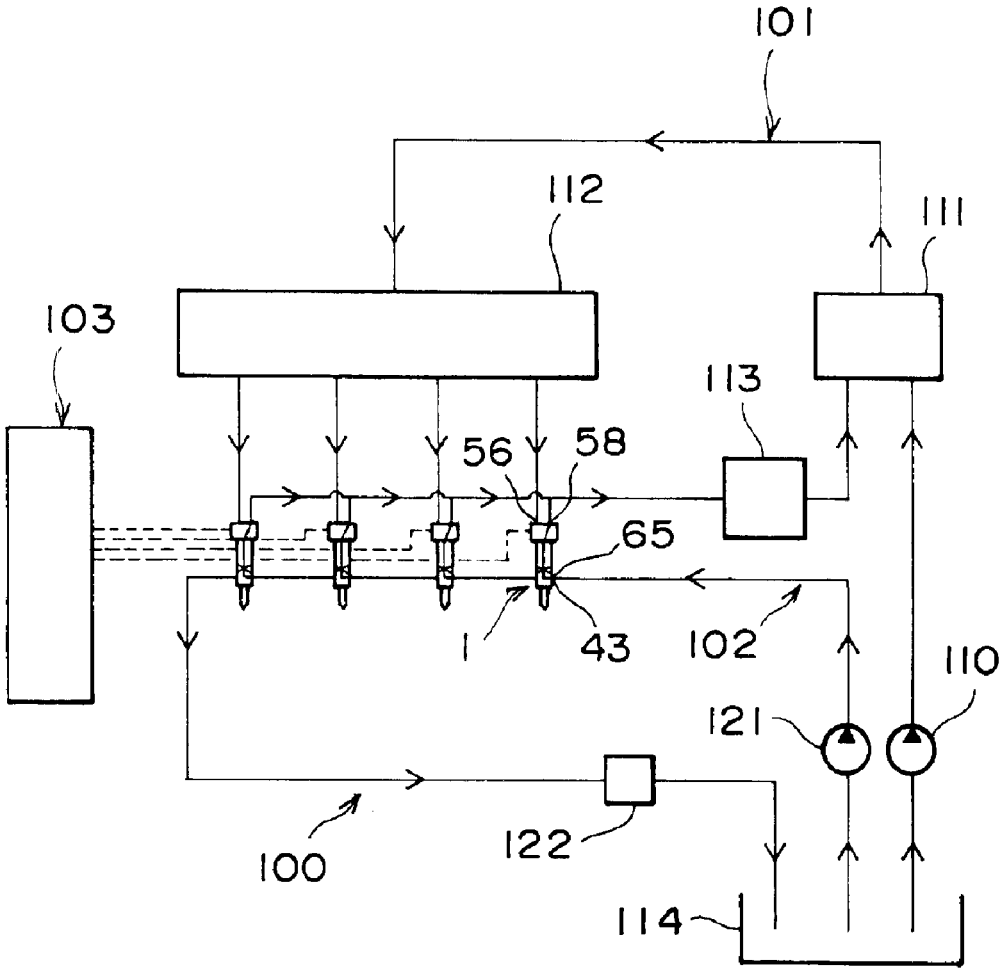
FIG. 2 is a schematic diagram showing a common-rail-type fuel injection device to which the fuel injector of this embodiment of the present invention is applied.

FIG. 2 is a schematic diagram illustrating a common rail type fuel injection device 100 to which the fuel injector 1 of FIG. 1 is applied. The fuel injection device 100 is provided with one or more fuel injectors 1 respectively mounted in the cylinder heads of an engine (not shown), and comprises an operating fluid circulation system 101 for supplying fuel to the fuel injectors 1 as the operating fluid and recovering it therefrom, a fuel supply system 102 for supplying fuel to the fuel injectors 1, and a control device 103 for controlling the opening and closing of the electromagnetic valves 4 of the fuel injectors 1.

The operating fluid circulation system 101 is formed by a fuel supply pump 110, a high-pressure pump 111, a common rail 112, a recovery device 113, etc. The fuel supply pump 110 transfers fuel in a fuel tank 114 under pressure to the high-pressure pump 111. The high-pressure pump 111 pressurizes the fuel, for example, to approximately 200 atmospheres, and the pressurized fuel is transferred under pressure to the common rail 112. The fuel stored in the common rail 112 in a pressurized state is supplied to the pressurizing chamber 42 (See FIG. 1) by way of the supply port 56 by the operation of the electromagnetic valve 4. The operating fluid discharged from the discharge port 58 by the operation of the electromagnetic valve 4 is recovered by the recovery device 113 as fuel, and the recovered fuel is recirculated by the high-pressure pump 111.

The fuel supply system 102 is formed by a pump 121 and a valve 122. The pump 121 pressurizes the fuel in the fuel tank 114 to approximately several atmospheres, and transfers the fuel under pressure to the supply port 43 of each fuel injector 1. The valve 122 adjusts the amount of fuel supplied to the fuel injectors 1. The control device 103 generates a control signal for controlling the opening and closing of the electromagnetic valve 4 of each fuel injector 1.

Provided in each fuel injector 1 is the throttle hole 65 which causes the fuel supplied from the supply port 43 to be transmitted to the discharge port 58 by way of the drain passages 46 and 63 (See FIG. 1). Thus, part of the fuel from the fuel supply system 102 flows to the discharge port 58 by way of the throttle hole 65.

Next, the operation of the fuel injector 1, constructed as described above, will be described with reference to FIGS. 1 and 3. FIG. 1 shows the operation state of the fuel injector 1 prior to injection, and FIG. 3 shows the operation state thereof at the time of injection.

The fuel injector 1 is assembled as shown in FIG. 1, and mounted in the fuel injection device 100 as shown in FIG. 2. At the time of mounting, the interior of the fuel injector 1 is filled with air.

In FIG. 1, prior to injection, low-pressure fuel is supplied from the supply port 43. The fuel supplied from the supply port 43 is conveyed to the pressure intensifying chamber 41 after passing the annular space 441, the lateral passage 442, the longitudinal passage 443, and the check valve 45. Further, it passes the supply passage 26 to fill the interior of the storage portion 24. In this filling process, the air existing in the fuel passage in the injection mechanism 2 or the pressure intensifying mechanism 3 is forced out by the fuel and rises through the passage in the fuel injector 1, which is vertically arranged. The rising air passes through the open check valve 45 and gathers in the annular space 441. The throttle hole 65 is open above the annular space 441, and the air having reached the annular space 441 is discharged to the first drain passage 46 by way of the throttle hole 65. Since the first drain passage 46 and the second drain passage 63 communicate with the discharge port 58, the air is discharged to the exterior of the fuel injector 1. As a result, the interior of the fuel injector 1 is filled with fuel only.

Figure 3:
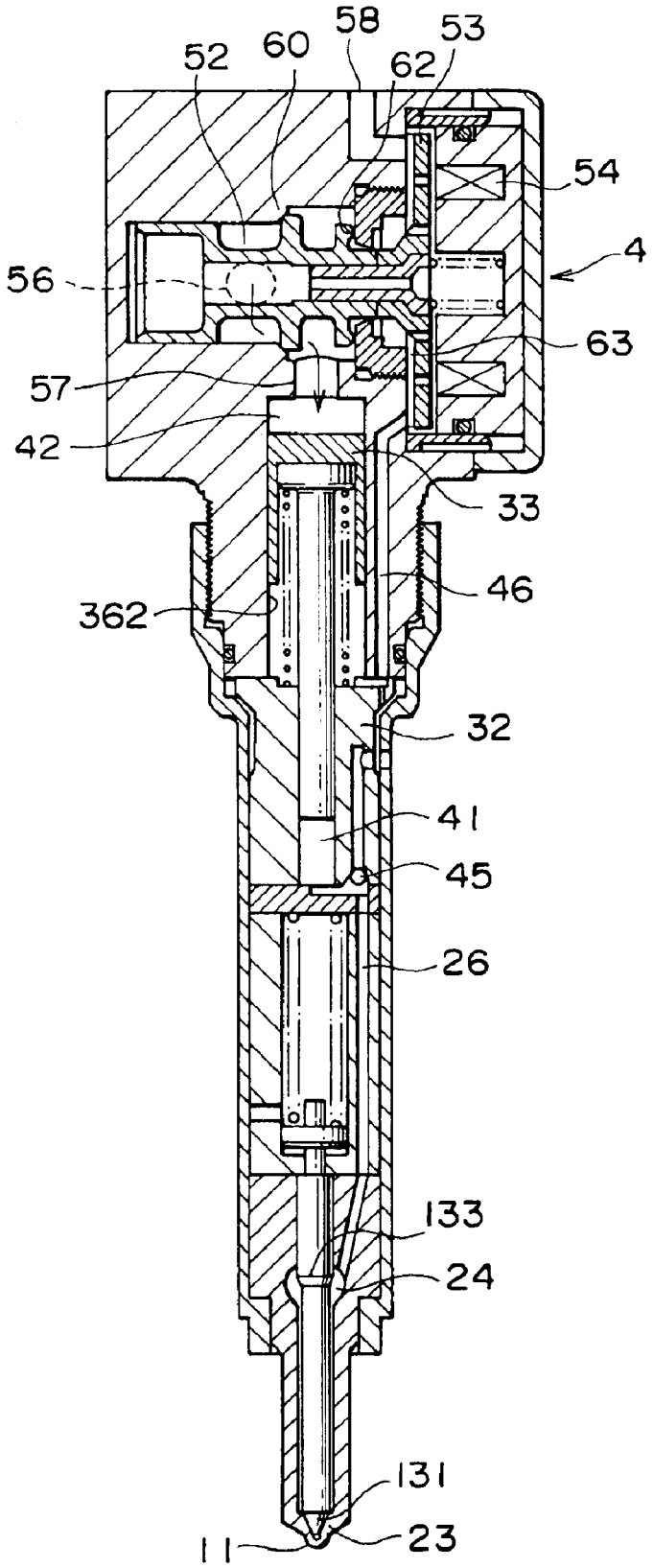
FIG. 3 is a sectional view showing the fuel injector of this embodiment of the present invention at the time of injection start.

As shown in FIG. 3, at the time of injection, the solenoid 54 of the electromagnetic valve 4 is energized, and the yoke 53 is attracted, causing the valve plug 52 to move to the right as seen in the drawing. Then, the first valve 60 is opened, and the second valve 62 is closed, with the result that the supply port 56 and the input/output port 57 communicate with each other, causing operating fluid to be introduced into the pressurizing chamber 42. The fuel in the pressure intensifying chamber 41 is pressurized at a pressure intensifying ratio determined by the ratio of the outer diameter of the pressure intensifying piston 33 to the outer diameter of the plunger 32. At this time, the check valve 45 is closed, and the high pressure of the pressure intensifying chamber 41 is propagated to the fuel in the storage portion 24 by way of the supply passage 26. When the high-pressure fuel in the storage portion 24 attains a pressure, for example, of approximately 200 atmospheres and the needle 13 overcomes the biasing force of the presser spring 14 to lift the valve portion 131 from the valve seat 23 by the step portion 133, etc. receive pressure, with the result that high-pressure fuel is injected from the injection port 11. The descent of the pressure intensifying piston 33 causes the fuel forced out of the accommodating chamber 362 to be discharged from the discharge port 58 by way of the first drain passage 46 and the second drain passage 63.

When the injection of high-pressure fuel is completed, the solenoid 54 of the electromagnetic valve 4 is changed to the non-energized state, and the valve plug 52 and the yoke 53 are moved to the left as seen in the drawing by the biasing force of the presser spring 59, causing the first valve 60 to be closed and the second valve 62 to be opened, with the result that the input/output port 57 and the discharge port 58 communicate with each other. Then, the operating fluid, which has been introduced into the pressurizing chamber 42, is discharged from the discharge port 58, and the pressure intensifying piston 33 and the plunger 32 are raised by the biasing force of the return spring 34 to return to the position shown in FIG. 1. The accommodating chamber 362 communicates with the first drain passage 46, the second drain passage 63, the second valve 62 in the open state, and the input/output port 57, so that A most of the operating fluid of the pressurizing chamber 42 circulates through the first drain passage 46 and the second drain passage 63.

When the fuel injector 1 is filled with fuel and remains at rest in this state for a long period of time, air, etc., which have been dissolved in the fuel, will be brought back to the gaseous state. The gas thus generated passes through the supply passage 26 and the check valve 45 and gathers in the annular space 441 having the throttle hole 65, where the pressure is at the minimum. Thus, when the engine is re-started, the gas generated is also bled from the throttle hole 65 as stated above.

The above-described embodiment provides the following advantages.

(1) Due to the construction in which there is provided a throttle hole 65 that is normally open on the drain passage 46 from the fuel supply passage 44, bleeding of gases such as air contained in the fuel injector 1 is effected simultaneously with the supply of fuel to the fuel injector 1 when the fuel injector 1 is re-mounted or the engine is started after a long rest. Thus, bleeding can be effected reliably, remarkably reducing the possibility of the fuel injector 1 performing improper injection.

(2) Since the throttle hole 65 is a bypass which is normally open on the drain passage 46, there is no need to perform control to open and close the throttle hole 65. The fact that it is a simple opening implies a superior durability. Further, it is free from secular changes.

(3) In FIG. 1, the throttle hole 65 is provided between the fuel supply passage 44 and the first drain passage 46 for the plunger 32. The first drain passage 46 of the plunger 32 and the fuel supply passage 44 leading to the pressure intensifying chamber 41 for the plunger 32 are close to each other, so that it is possible to provide a short throttle hole 65 between them. Thus, the throttle hole 65 can be formed by minimum machining of the existing parts, involving no increase in weight and cost due to additional parts.

(4) In FIG. 1, the throttle hole 65 communicates with the discharge port 58 by way of the first drain passage 46 and the second drain passage 63, so that it is possible to allow the leak fuel from the throttle hole 65 to flow with the leak fuel from the pressure intensifying mechanism 3 and the leak fuel from the electromagnetic valve 4, making it possible to effect discharge from the throttle hole 65 by a simple route. Thus, there is no need to separately provide a port for recovering the leak fuel from the throttle hole 65.

(5) In FIG. 1, a recess is provided in the outer periphery of the portion of the fourth body 35 extending down to the fuel supply passage 44, and this recess constitutes the annular space 441 communicating with the fuel supply passage 44, the throttle hole 65 being open above this annular space 441. Due to this construction, air gathers in the annular space 441 situated above the fuel supply passage 44. Since the air gathered in the annular space 441 is bled through the throttle hole 65 which is open above the annular space 441, the air contained in the fuel is bled reliably.

The present invention is not restricted to the above-described embodiment. For example, the following modifications are possible.

Figure 4:
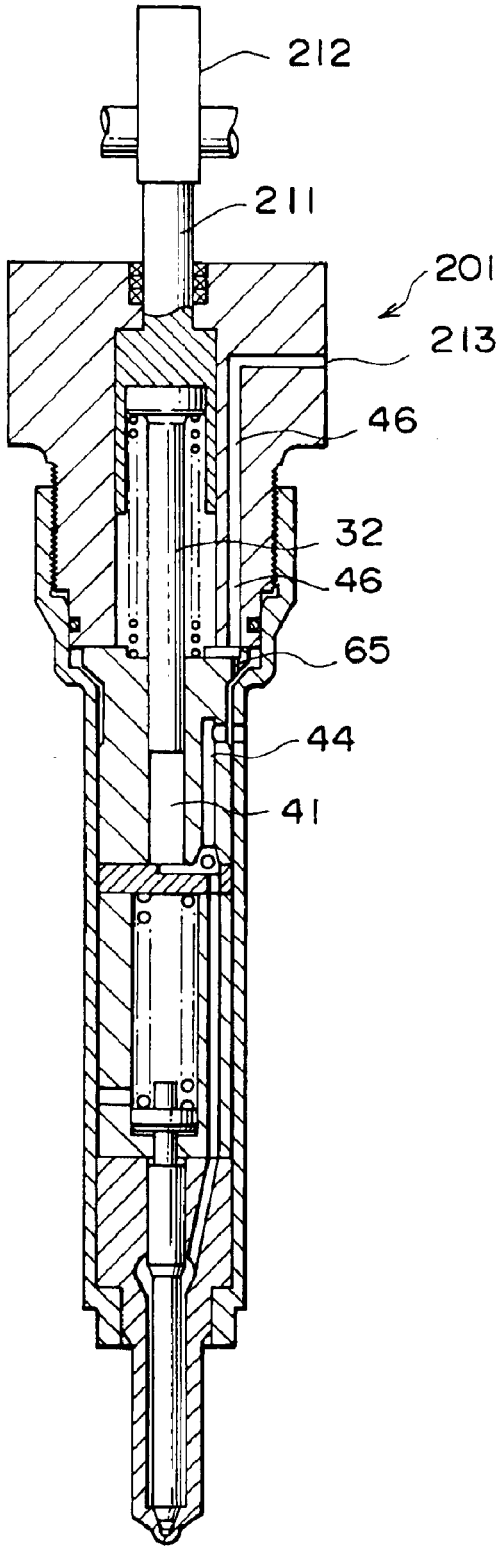
FIG. 4 is a sectional view showing a fuel injector according to another embodiment of the present invention in a state prior to injection start.

(1) As shown in FIG. 4, the present invention is also applicable to a fuel injector 201 of the type in which the pressure intensifying mechanism is not formed by a pressure intensifying cylinder operated by an electromagnetic valve but uses an external force to push down the plunger 32. In this case, the plunger 32 is connected to a presser bar 211 whose forward end abuts a cam 212. The cam 212 is adapted to rotate with the rotation of the engine. As the cam 212 rotates, the plunger 32 moves vertically to pressure-intensify the fuel in the pressure intensifying chamber 41. In this case also, the throttle hole 65 is provided between the fuel supply passage 44 and the first drain passage 46. The fuel flowing through the first drain passage 46 is discharged through a discharge hole 213 and recovered by a fuel tank or the like.

(2) In the common rail type fuel injection device 100 of FIG. 2, it is possible for the fuel from the discharge port 58 in the operating fluid recirculation system 101 to be returned directly to the fuel tank 114 for circulation without passing the recovery device 113.

(3) In FIG. 1, the throttle hole 65 may consist of a throttle passage which is open on the second drain passage 63 and which is arranged side by side with the first drain passage 46. When the first drain passage 46 is situated above, it is advantageous, in some cases, for the throttle hole 65 to open on the second drain passage 63 than on the first drain passage 46.

What is claimed is:

1. A fuel injector comprising:

a pressure intensifying chamber communicating with a fuel supply passage through a check valve, a plunger for pressure-intensifying fuel introduced into said pressure intensifying chamber, and a needle valve for injecting the fuel pressure-intensified in said pressure intensifying chamber through an injection port, wherein there is provided in said fuel supply passage a throttle passage normally communicating with a fuel drain passage, and wherein said fuel supply passage has an annular space situated around said plunger and extending vertically in the axial direction, and wherein said throttle passage communicates with a portion above said annular space.

2. A fuel injector comprising:

a pressure intensifying chamber communicating with a fuel supply passage through a check valve, a plunger for pressure-intensifying fuel introduced into said pressure intensifying chamber, and a needle valve for injecting the fuel pressure-intensified in said pressure intensifying chamber through an injection port, wherein there is provided in said fuel supply passage a throttle passage normally communicating with a fuel drain passage, and wherein said fuel supply passage extends from a fuel supply port, and said throttle passage constantly feeds a small amount of fuel from the fuel supply port to the fuel drain passage.

3. A fuel injector according to claim 2, wherein said plunger is formed in a pressure intensifying cylinder using a fuel supplied and discharged by an electromagnetic valve as an operating fluid, and wherein a first drain passage upstream from the check valve communicates with a second drain passage for said electromagnetic valve.

* * * * *

UNITED STATES PATENT AND TRADEMARK OFFICE

CERTIFICATE OF CORRECTION

PATENT NO. : 6,908,042 B2
DATED : June 21, 2005
INVENTOR(S) : Hiroshi Kuzuyama

It is certified that error appears in the above-identified patent and that said Letters Patent is hereby corrected as shown below:

Column 7,
Line 11, delete “so that A most” and replace with -- so that most --.

Signed and Sealed this

Twenty-seventh Day of September, 2005

JON W. DUDAS
*Director of the United States Patent and Trademark Office*